US007254478B1

(12) United States Patent
Herman et al.

(10) Patent No.: US 7,254,478 B1
(45) Date of Patent: Aug. 7, 2007

(54) METHOD OF ESTIMATING AIRFLOW IN AN AIR INJECTION REACTION SYSTEM

(75) Inventors: Andrew D. Herman, Grand Blanc, MI (US); Peter M. Olin, Ann Arbor, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/395,987

(22) Filed: Mar. 31, 2006

(51) Int. Cl.
*G06F 19/00* (2006.01)
*F01N 3/00* (2006.01)

(52) U.S. Cl. ..... 701/114; 60/285; 60/277

(58) Field of Classification Search ..... 701/114, 701/102; 123/399, 361, 568.21; 60/274, 60/277, 284, 285
See application file for complete search history.

(56) References Cited

U.S. PATENT DOCUMENTS 3,785,152 A * 1/1974 Pozniak et al. ..... 60/290
3,872,666 A * 3/1975 Bentley ..... 60/277
5,845,627 A 12/1998 Olin et al. ..... 123/676
6,155,043 A * 12/2000 Zhang et al. ..... 60/284

* cited by examiner

*Primary Examiner*—Hieu T. Vo
(74) *Attorney, Agent, or Firm*—Paul L. Marshall

(57) ABSTRACT

A method of estimating the quantity of secondary reaction airflow supplied to the exhaust manifold of an internal combustion engine by an air injection reaction (AIR) system models airflows in an AIR pump, an AIR valve, and a plenum coupling the pump to the valve. The pump flow is modeled based on the pump speed (or pump motor voltage), the pump inlet air temperature and the pressure ratio across the pump, and the valve flow is modeled based on the pressure ratio across the valve and the valve inlet air temperature. The plenum pressure used in the pump and valve pressure ratios is modeled based on the net plenum airflow and the plenum air temperature. The estimated AIR airflow is useful for managing the air/fuel ratio in the engine exhaust system and enhancing the reliability of AIR diagnostics.

6 Claims, 2 Drawing Sheets

METHOD OF ESTIMATING AIRFLOW IN AN AIR INJECTION REACTION SYSTEM

TECHNICAL FIELD

The present invention relates to the injection of secondary reaction air into the exhaust manifold of an internal combustion engine for emission control purposes, and more particularly to a method of estimating the magnitude of secondary airflow.

BACKGROUND OF THE INVENTION

A known technique for reducing hydrocarbon emissions in internal combustion engines involves injecting secondary air into the engine exhaust manifold. This technique, usually referred to as Air Injection Reaction or simply AIR, is particularly important during engine warm-up following a cold start. Under such conditions, the air/fuel mixture supplied to the engine cylinders is relatively low (rich) to ensure stable combustion, and the injected air promotes rapid light-off of the exhaust system catalytic converter to enable early initiation of closed-loop fuel control. The secondary air promotes light-off of the catalytic converter by reacting with unburned hydrocarbons in the exhaust gas to produce heat, and by raising the air/fuel ratio in the exhaust system to an optimum level for converter light-off. In practice, however, it is difficult to optimize the injection of secondary air because the delivered airflow varies considerably depending on environmental factors such as ambient temperature and barometric pressure. This makes it difficult to take full advantage of AIR and can also lead to incorrect diagnosis of an AIR failure under conditions which severely restrict AIR airflow. Accordingly, what is needed in a method of accurately and reliably estimating AIR airflow, both for control and diagnostic purposes.

SUMMARY OF THE INVENTION

The present invention is directed to an improved method of estimating the secondary reaction airflow supplied to an internal combustion engine by modeling airflows in an AIR pump, an AIR valve, and a plenum coupling the pump to the valve. The pump flow is modeled based on the pump speed (or pump motor voltage), the pump inlet air temperature and the pressure ratio across the pump, and the valve flow is modeled based on the pressure ratio across the valve and the valve inlet air temperature. The plenum pressure used in the pump and valve pressure ratios is modeled based on the net plenum airflow and the plenum air temperature. The estimated AIR airflow is useful for managing the air/fuel ratio in the engine exhaust system and enhancing the reliability of AIR diagnostics.

DESCRIPTION OF THE PREFERRED EMBODIMENT

Figure 1:
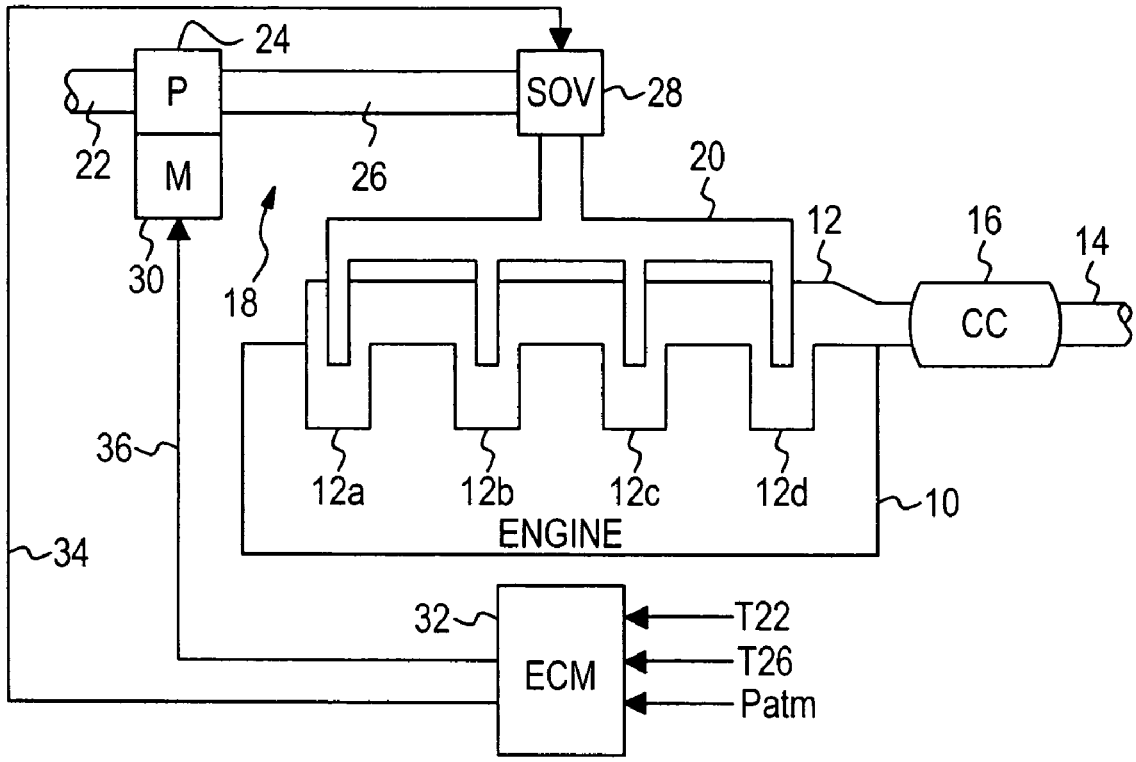
FIG. 1 is a diagram of an air injection reaction system for an internal combustion engine, and a microprocessor-based engine control unit for carrying out the method of this invention.

Referring to FIG. 1, the present invention is described in the context of a four-cylinder automotive internal combustion engine 10 having an exhaust manifold 12 for receiving exhaust gases and directing them to a tail pipe 14 by way of a three-way catalytic converter (CC) 16. An air injection reaction (AIR) system, generally designated by the reference numeral 18, supplies secondary air to the runners 12*a*, 12*b*, 12*c*, 12*d* of exhaust manifold 12 via the AIR manifold 20 for purposes of reducing exhaust emissions and managing the air/fuel ratio in the vicinity of catalytic converter 16. In addition to the manifold 20, the AIR system 18 includes an ambient air inlet pipe 22, an air pump 24, a plenum 26, an electrically activated shut-off valve (SOV) 28 coupling plenum 26 to AIR manifold 20, and an electric motor 30 drivingly connected to pump 24. Activation of SOV 28 and motor 30 are controlled by a microprocessor-based engine control module (ECM) 32 via lines 34 and 36, respectively. In operation, the ECM 32 activates motor 30 to drive pump 24, and activates SOV 28 to connect plenum 26 to manifold 20 for supplying secondary air to the exhaust manifold runners 12*a*–12*d*. Otherwise, the ECM 32 deactivates motor 30 and SOV 28, isolating plenum 26 from the manifold 20.

Alternatively, the pump 24 may be driven by engine 10; in such case, the AIR system additionally includes either an electrically activated clutch for selectively activating pump 24, or an electrically activated diverter valve for selectively coupling the plenum 26 to manifold 20 or atmosphere. However, the illustrated arrangement is preferred because it facilitates speed control of the pump 24 for the purpose of regulating the flow of secondary air. This may be particularly important during an engine warm-up period following a cold start, since the catalytic converter 16 lights-off more rapidly when the air/fuel ratio of the exhaust gas supplied to its inlet is maintained in a given range (which is typically leaner than the engine combustion products during cold start and warm-up).

Since ECM 32 also manages the engine air/fuel ratio, the desired flow of secondary air can be easily computed, and ECM 32 activates motor 30 at a corresponding speed. However, the actual secondary airflow (that is, the flow through SOV 28) is subject to significant variability depending on conditions that influence the backpressure in exhaust manifold 12, and it is difficult to verify that the desired flow is actually being achieved. The present invention addresses this issue with a model-based method of accurately estimating the secondary airflow (F28) through SOV 28, based on known or easily determined parameters such as the pump speed PMP_SPD (or the motor voltage), the air temperature T22 in pump inlet 22, the air temperature T26 in AIR plenum 26, and the atmospheric pressure Patm.

Figure 2:
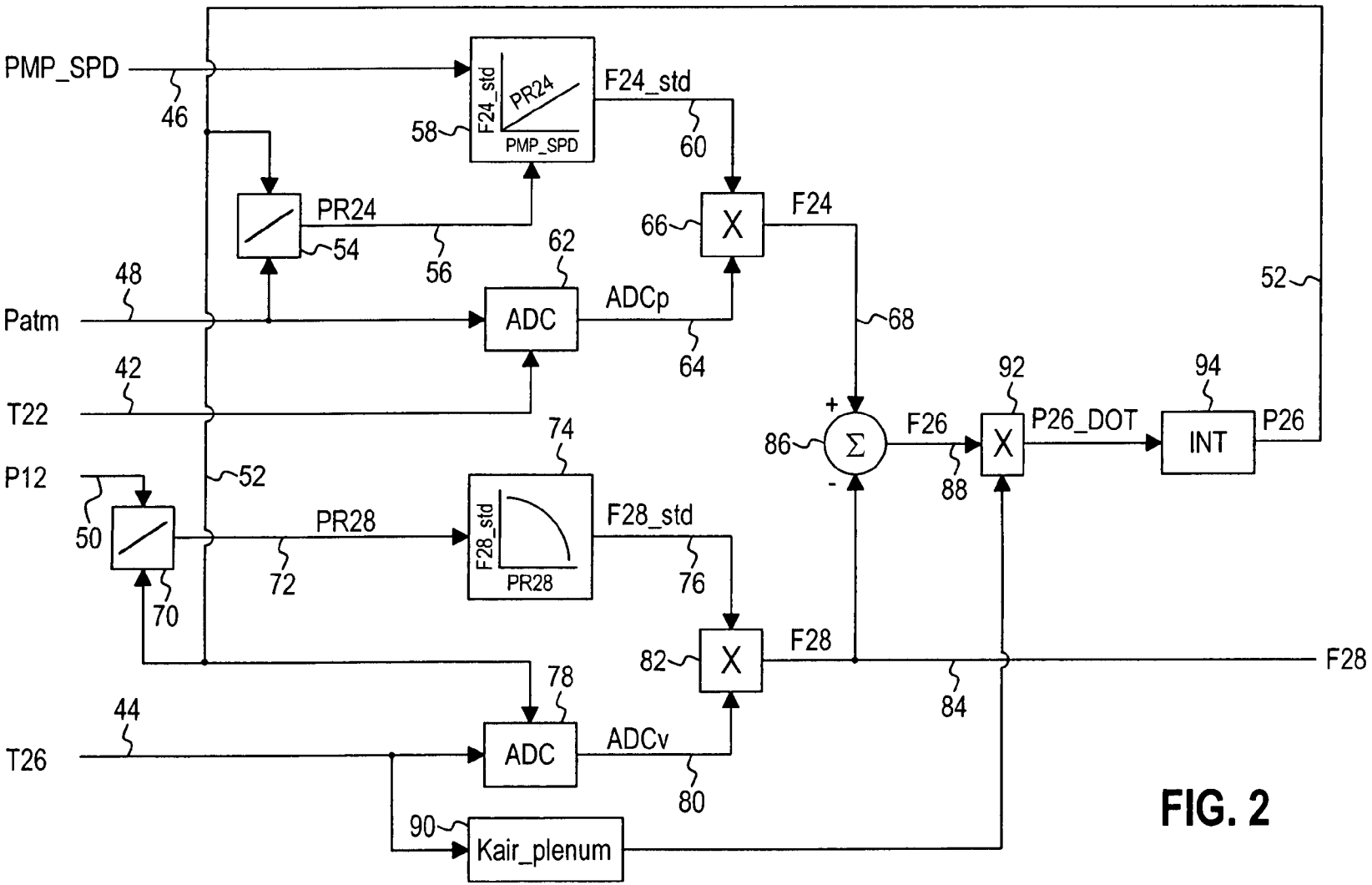
FIG. 2 is a block diagram of a secondary air reaction airflow estimation method carried out by the engine control unit of FIG. 1 according to this invention.

The block diagram of FIG. 2 illustrates the functionality of a software routine periodically executed by ECM 32 in carrying out the flow estimation method of this invention. The inputs to the block diagram include the temperatures T22 and T26 on lines 42 and 44, the pump speed PMP_SPD on line 46, the pressure Patm on line 48, and the exhaust manifold gas pressure P12 on line 50. The temperatures T22, T26 may be directly measured with suitably located temperature sensors (not shown), or may be estimated using temperature information used by ECM 32 for other engine control purposes. The pump input PMP_SPD may be the commanded pump speed, a measured pump speed, or the measured or inferred voltage of motor 30. The atmospheric pressure Patm may be measured or determined from other parameters, and the pressure P12 may be measured with a suitably located pressured sensor, but is preferably determined by a modeling technique such as disclosed in the U.S. Pat. No. 5,845,627 to Olin et al., issued on Dec. 8, 1998, assigned to the assignee of the present invention, and incorporated herein by reference.

The Pump Flow Calculation blocks 54, 58, 62, 66 develop an estimate F24_std of the airflow through pump 24. As indicated, the block 58 incorporates a look-up table based on empirically determined data (under standard temperature and pressure conditions) for the flow through pump 24 as a function of PMP_SPD and a ratio PR24 of the pump inlet and outlet pressures. The pump inlet pressure is the atmospheric pressure Patm on line 48, while the pump outlet pressure is the modeled AIR plenum pressure P26 on line 52. The pressure ratio P24 is computed in block 54 as shown. The blocks 62 and 66 compensate the output F24_std of block 58 for actual pressure and temperature conditions of the air entering pump 24. The block 62 develops a pump air density correction ADCp based on inlet pressure Patm and inlet temperature T22, relative to the standard pressure and temperature, and the correction ADCp is multiplied by F24_std at block 66 to produce a density corrected pump flow estimate F24 on line 68.

The System Flow Calculation blocks 70, 74, 78, 82 develop an estimate F28_std of the airflow through SOV 28. As indicated, the block 74 incorporates a look-up table based on empirically determined data (under standard temperature and pressure conditions) for the flow through SOV 28 as a function of a ratio PR28 of the inlet and outlet pressures of SOV 28. The inlet pressure is the modeled AIR plenum pressure P26 on line 52, while the outlet pressure is the exhaust manifold pressure P12 on line 50. The pressure ratio P28 is computed at block 70 as shown. The blocks 78 and 82 compensate the output F28_std of block 74 for actual pressure and temperature conditions of the air entering SOV 28. The block 78 develops a valve air density correction ADCv based on the modeled inlet pressure P26 on line 52 and the inlet temperature T26 on line 44, relative to the standard pressure and temperature, and the correction ADCv is multiplied by F28_std at block 82 to produce a density corrected system flow estimate F28 on line 84. As indicated above, ECM 32 uses this flow estimate to verify that the desired secondary airflow is being achieved; this is useful both for control purposes (that is, for regulating the speed of motor 30 or compensating the quantity of fuel supplied to engine 10 to achieve the optimal air/fuel ratio at the inlet of catalytic converter 16) and diagnostic purposes (that is, for verifying correct operation of the AIR system 18). Other uses of the estimated secondary airflow F28 may occur as well.

The blocks 86, 92 and 94 use the flow estimates F24 and F28 and the AIR plenum temperature T26 to update the modeled AIR plenum pressure P26 on line 52. The summation block 86 subtracts the system flow estimate F28 from the pump flow estimate F24 to form the net plenum flow estimate F26 on line 88, and the blocks 90 and 92 convert the flow estimate F26 to a corresponding change in plenum pressure (P26_DOT) based on the equation:

$$P26_DOT=(F26*R*T26)/V$$

where R is a gas constant for air, and V is the volume of AIR plenum 26. The plenum temperature T26 is applied to block 90, and the constant Kair_plenum of block 90 includes the terms R and V. Finally, the integrator block 94 integrates P26_DOT over the fixed update rate of ECM 32 to form the new estimate of the modeled plenum pressure P26 for application to the blocks 54, 70 and 78.

While the present invention has been described in reference to the illustrated embodiments, it is expected that various modifications in addition to those mentioned above will occur to those skilled in the art. Thus, it will be understood that methods incorporating these and other modifications may fall within the scope of this invention, which is defined by the appended claims.

The invention claimed is:

1. A method of estimating an airflow delivered to an exhaust manifold of an internal combustion engine by an air injection reaction system including a driven air pump and a plenum coupling an outlet of the air pump to the exhaust manifold, the method comprising the steps of:

estimating an airflow through the pump based on an operating parameter of the pump, an inlet pressure of the pump, an inlet air temperature of the pump, and an estimate of an air pressure in said plenum;

estimating the airflow delivered to the exhaust manifold based on a pressure in the exhaust manifold, an air temperature in the plenum, and the estimate of the air pressure in said plenum; and updating the estimate of the air pressure in said plenum based on a difference between the estimated airflow through the pump and the estimated airflow delivered to the exhaust manifold, and the air temperature in the plenum.

2. The method of claim 1, wherein the operating parameter of the pump is a driven speed of the pump.

3. The method of claim 1, including the step of:

determining the inlet pressure of the pump according to a measure of atmospheric pressure.

4. The method of claim 1, wherein the step of estimating the airflow through the pump includes the steps of:

retrieving a previously determined airflow based on the operating parameter of the pump and a ratio of the inlet pressure of the pump and the estimated air pressure in said plenum, with a standard air pressure and a standard air temperature; and correcting the retrieved airflow based on the inlet air temperature of the pump and the inlet pressure of the pump, relative to the standard air temperature and the standard air pressure.

5. The method of claim 1, wherein the step of estimating the airflow delivered to the exhaust manifold includes the steps of:

retrieving a previously determined airflow based on a ratio of the pressure in the exhaust manifold and the estimated air pressure in said plenum, with a standard air pressure and a standard air temperature; and correcting the retrieved airflow based on the air temperature in the plenum and the estimated air pressure in said plenum, relative to the standard air temperature and the standard air pressure.

6. The method of claim 1, wherein the step of updating the estimate of the air pressure in said plenum includes the steps of:

determining a rate of change of air pressure in said plenum based on the difference between the estimated airflow through the pump and the estimated airflow delivered to the exhaust manifold, the air temperature in the plenum, and known characteristics of said plenum; and integrating the rate of change of air pressure in said plenum to determine an updated estimate of the air pressure in said plenum.

* * * * *